166-307 SR
8/23/83 XR 4,400,034

United States Patent [19] [11] 4,400,034
Chew [45] Aug. 23, 1983

[54] COAL COMMINUTION AND RECOVERY PROCESS USING GAS DRYING

[75] Inventor: Ju-Nam Chew, Dallas, Tex.

[73] Assignee: Mobil Oil Corporation, New York, N.Y.

[21] Appl. No.: 232,618

[22] Filed: Feb. 9, 1981

[51] Int. Cl.[3] ..... B02C 19/00; E21C 41/04

[52] U.S. Cl. ..... 299/5; 166/259; 166/307; 241/1; 241/18; 299/4

[58] Field of Search ..... 241/1, 18; 166/256, 166/259, 303, 307, 271; 299/4, 5; 44/10 E, 10 F, 10 J

[56] References Cited

U.S. PATENT DOCUMENTS

| | | | |
|---|---|---|---|
| 1,426,733 | 8/1922 | Ford | 44/10 E |
| 1,532,826 | 4/1925 | Lessing | 241/1 X |
| 3,815,826 | 6/1974 | Aldrich et al. | 241/1 |
| 3,870,237 | 3/1975 | Aldrich | 241/1 |
| 4,032,193 | 6/1977 | Drinkard et al. | 241/1 X |
| 4,123,108 | 10/1978 | Lavon | 241/1 X |
| 4,130,164 | 12/1978 | Datta | 166/259 |
| 4,132,448 | 1/1979 | Davis | 241/1 X |
| 4,158,550 | 6/1979 | Weber et al. | 44/13 |
| 4,191,425 | 3/1980 | Davis | 241/1 X |
| 4,239,496 | 12/1980 | Cochran | 241/18 |

*Primary Examiner*—Stephen J. Novosad
*Attorney, Agent, or Firm*—Chalres A. Huggett; James F. Powers, Jr.; Lawrence O. Miller

[57] ABSTRACT

This invention is a comminution process for treating coal with a drying gas to form fractures which weaken the structure of the coal and make it easier to disintegrate mechanically, chemically or by fluid force. Another aspect of this invention is a process for treating an underground formation of coal with a dry gas for a time sufficient to form cracks and fractures in a portion of the formation in order to increase the permeability of the coal formation to the flow of fluids therethrough. Processes for in-situ combustion of the coal formation are therefore more efficient since the coal formation is more permeable to the flow of gas therethrough.

11 Claims, 2 Drawing Figures

COAL COMMINUTION AND RECOVERY PROCESS USING GAS DRYING

BACKGROUND OF THE INVENTION

As the result of the declining availability of oil, more emphasis has been directed toward the problem of more effective utilization of coal. Two methods are generally used for removing coal from the ground, either strip mining, in which the coal is merely dug out of the ground by mechanical or hydraulic means and transferred to the place of use, or underground mining using methods such as slurry mining, room and pillar, or long wall.

Comminution of coal into pieces of manageable size has been accomplished by mechanical means, explosives or by chemical means.

Processes for chemical comminution of coal, both above ground and below ground have been disclosed in U.S. Pat. Nos. 3,815,826 to Aldrich et al., 3,870,237 to Aldrich and 4,032,193 to Drinkard et al. According to these processes, the interlayer forces at natural interfaces present in the coal is weakened by contact with a number of reagents such as gaseous anhydrous ammonia, liquid anhydrous ammonia, aqueous ammonia, organic solvents, alcohols containing sodium hydroxide, and aqueous solutions of sodium hydroxide.

Underground gasification of coal has been carried out in a number of cases to extract the energy of the coal while it is still underground. In underground coal gasification processes, a combustible gas is produced which is brought to the earth's surface and transported by pipelines. One difficulty of underground gasification is the low permeability of coal to the flow of gas therethrough. Combustion in the coal seam cannot be carried out efficiently unless an oxygen-containing gas can be passed through the seam. To cope with this problem, it has been the practice to introduce explosives into the coal seam to fracture the coal, or pneuamtic and hydraulic fracturing can sometimes be utilized. Also, permeability can be increased by injecting solvents into the coal seam as taught by U.S. Pat. No. 4,130,164 to Datta. This patent teaches the use of solvents that include various forms of ammonia and methanol that increase the permeability of the coal to the flow of fluid therethrough.

It has now been discovered that by contacting the coal formation with a dry gas such as air, oxygen, oxygen-enriched air, carbon dioxide, argon, nitrogen, methane or helium, permeability of the coal formation is increased to permit fluid flow in in-situ coal gasification processes. Also, gas-drying the coal in combination with mechanical or chemical comminution enhances disintegration of the coal and enables the coal to be more easily removed mechanically or by slurry mining.

SUMMARY OF THE INVENTION

Broadly, this invention is a process for treating subterranean coal which comprises contacting said coal with a dry gas such as air, oxygen, oxygen-enriched air, methane, argon, carbon dioxide, nitrogen, or helium, and for a time sufficient to develop an intersecting network of cracks or fractures in the coal that weakens the coal structure and makes it easier to disintegrate either chemically or mechanically. This process can be used to increase the permeability of coal seams to the flow of gas therethrough which is important in underground coal gasification processes. Combustion cannot be carried out efficiently unless a combustion-supporting gas can be passed through the coal seam between injection and production boreholes. This process enables the permeability of the coal seam to be increased so that combustion-supporting gas and production gas can pass therethrough.

The process can also be used to more easily recover coal from an underground seam in a slurry mining process. Air, argon, nitrogen, or some other drying gas can be circulated through a portion of the coal seam through a single borehole equipped with injection tubing or through a system of separate injection and production boreholes. After the fracture pattern has been developed, the coal can be fragmented and pushed or pumped to the surface by using high velocity air or water or various chemicals such as aqueous solutions of ammonia or sodium hydroxide.

The process can also be used as a step in more easily disintegrating large lumps of surface coal. Chemical comminution of surface coal is greatly improved by this process wherein the coal is first treated with a drying gas such as air, argon or nitrogen. This process is particularly effective when the coal is chemically treated with aqueous solutions of sodium hydroxide. Gas-drying the coal forms a network of fractures in the coal and when the coal is treated with aqueous solutions of the sodium hydroxide, the coal disintegrates more easily than without the drying step.

DESCRIPTION OF THE PREFERRED EMBODIMENT

This is a process for the comminution of coal by treatment with dry gas whether in a sub-surface stratum or in large lumps as mixed by standard means. The types of coal which can be treated using the process of this invention, includes lignite, sub-bituminous and bituminous. The process is particularly useful for sub-bituminous coal, especially those deposits found in Western United States, such as Wyoming.

It has been found that coal will develop an intersecting network of cracks or fractures upon exposure to a dry gas such as air, oxygen, oxygen-enriched air, argon, nitrogen, helium, carbon dioxide or methane or mixtures thereof. The preferred drying gas is air or nitrogen due to their economic availability. Comminution is particularly effective when the coal is first gas-dried to form fractures and then disintegrating the coal along the fracture pattern with some mechanical or fluid force or in particular by contacting the coal with a solvent such as aqueous alkaline solutions, particularly sodium hydroxide. The alkaline treatment process particularly useful in this process is the one taught by U.S. Pat. No. 4,032,193 to Drinkard et al. and as much of that patent is pertinent here is incorporated by reference. Other chemical comminution reagents useful in combination with this process include anhydrous liquid ammonia, anhydrous gaseous ammonia, aqueous ammonia and combinations thereof, methanol, and acids as described in U.S. Pat. Nos. 1,532,826 to Lessing; 3,815,826 to Aldrich et al., 3,870,237 to Aldrich and 4,130,164 to Datta and as much as those patents as is pertinent is incorporated by reference herein.

Figure 1:
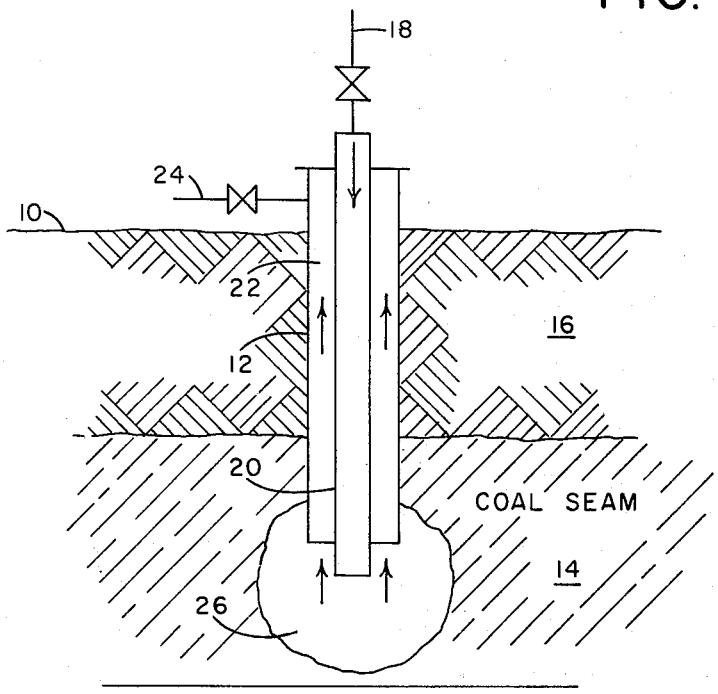
FIG. 1 is a simplified drawing of the cross-section of a single borehole between the earth's surface and a coal seam.

Referring to FIG. 1, when the coal lies beneath the earth's surface 10, a borehole 12 is drilled communicating between the earth's surface 10 and the coal formation 14 and penetrating overburden 16. Dry air is injected through line 18 and tubing string 20 and into contact with the coal seam 14. The dry gas penetrates the coal seam 14 and is continuously injected into the coal seam and circulated therein for a sufficient time to absorb moisture from the coal and develop a network of cracks or fractures in the coal which increases the permeability of the coal to the flow of fluid therethrough in the zone surrounding the lower end of the borehole 12. All or a portion of the moistened gas not lost in the coal seam is withdrawn through the annular opening 22 and line 24. The moistened gas withdrawn through line 22 may be de-humidified on the surface by conventional means and recycled to the coal seam. The quantity of dry gas injected into the coal seam will vary with the rank of the coal and the amount of water content contained therein. To increase the surface area of the coal exposed to the drying gas around the underground end of the wall borehole, a cavity 26 may be formed by explosive means, hydraulic pressure, or mechanical means known in the art. Once the permeability of the coal surrounding the lower end of the borehole 12 has reached a desired level, injection of the drying gas is discontinued and a basic aqueous solution is injected into contact with the coal seam 14 through line 18 and tubing string 20. The basic aqueous solution is allowed to maintain contact with the coal for a sufficient time to disintegrate or fragment the coal. The rate of the basic aqueous solution pumped down pipe 20 into contact with the coal is increased and the solution consisting of coal fragments produced by contact of the basic solution with the coal seam 14 suspended or fluidized in the form of a coal slurry is pumped out of the coal seam through annular opening 22 and pipe 24 to a storage vessel not shown. The roles of the pipe 20 and the annular opening 22 may be reversed.

The basic aqueous solution useful in the process include, but is not limited to, sodium hydroxide, ammonia, potassium hydroxide, sodium carbonate, and potassium carbonate and combinations thereof. The preferred solution is sodium hydroxide. Concentrations in water solution can range from 0.01 molar to 5 molar.

The process is not limited to the arrangement of FIG. 1 which utilizes a solvent for disintegrating the coal once it has been fractured and weakened by treatment with a drying gas. Therefore, other conventional comminution means may be used in combination with the drying treatment in accordance with the process shown in FIG. 1 such as mechanical disintegration using an agitating tool or the use of slurry mining hydraulic apparatus in which a pressurized fluid such as water is directed at the coal seam to disaggregate the coal and form a slurry which is then pumped out of the coal seam to the surface. In the technique of mechanical comminution, the disintegrated particles of coal may be lifted pneumatically from the coal seam to the surface.

Figure 2:
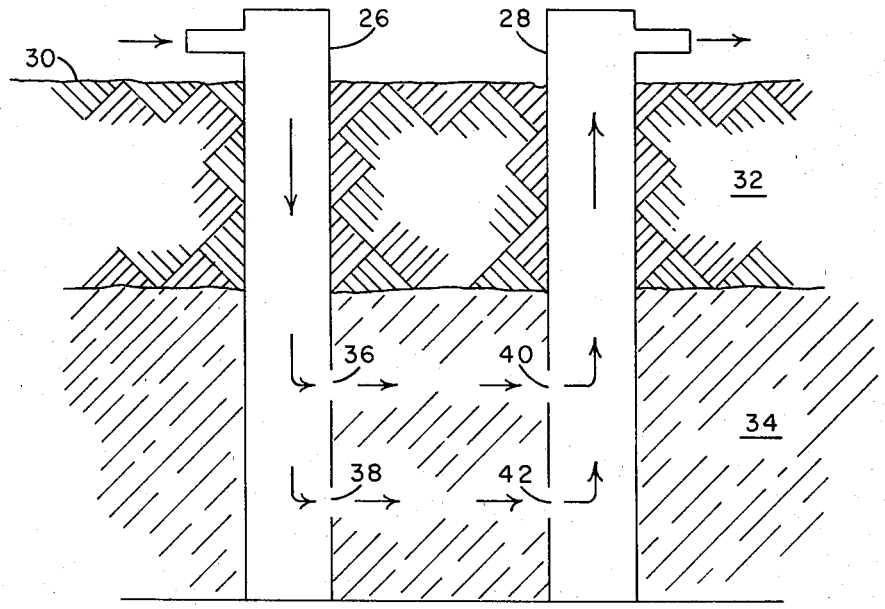
FIG. 2 shows a cross-section of a formation penetrated by an injection well and a production well for carrying out the coal gasification process of the present invention.

Another embodiment of the process is to increase the permeability of the coal seam between boreholes used in in-situ underground coal gasification. FIG. 2 shows an injection well 26 and a production well 28 penetrating from the earth's surface 30 through overburden 32 into a coal seam 34. In the underground gasification of coal, a combustion-supporting gas such as air or oxygen is introduced through the injection well 26, the coal is ignited and the combustion products are removed through the production well 28. The gaseous permeability of the usual coal seam is too low to permit transfer of gas from the injection well to the production well. Accordingly, it becomes necessary to increase the permeability of the coal seam by fracturing the formation using conventional means such as explosives, solvents, back burning or directionally-drilled holes. The process of the present invention is utilized for producing the necessary permeability rather than explosives, solvents or other methods. Thus, dry air is introduced into the coal seam 34 through injection well 26 and forced through the coal seam 34 to the production well 28. The dry air penetrates the coal and absorbs moisture which weakens the coal structure and forms fractures in the coal thereby increasing substantially its permeability. Introduction of the dry air is continued for a sufficient period of time so that the permeability of the coal seam 34 is increased substantially to the flow of fluid therethrough over the entire region between wells 26 and 28. The dry air enters the coal seam 34 through perforations 36 and 38 in the lower end of the injection well 26 and is directed toward production well 28. Production well 28 has perforations 40 and 42 to provide communication between the coal seam 34 and said production well 28 for withdrawal of the moistened air. After sufficient enhancement of the permeability of the coal seam between the two wells, introduction of the dry air is discontinued and in-situ combustion is then started in the manner described. The moistened air from the production well may be de-humidified and recycled to the injection well. A higher injection pressure may be required initially to establish communication between injection and production wells. A pattern involving a multiplicity of injection and production wells, in equal or unequal numbers of each, may be used. For example, a central injection well may be surrounded by a plurality of production wells in a ring pattern, such as a 5-spot well pattern.

The dry gas may be heated, however, its temperature is not critical to the process and is preferably in the range of 20°–150° C. Of course, the higher the temperature, the faster the rate of drying.

This invention will be further explained in detail with reference to the following embodiments which are given by way of illustration only and not by way of limitation.

EMBODIMENT I

Two samples of sub-bituminous coal from the Ucross seam at the Tipperary Coal Prospect, near Buffalo, Wyo. were treated. Both samples were ¼—circle sectors (pie-shaped wedges) of approximately 1.5-inch first radius, 1.5-inch second radius, 2-inch chord and 1-inch thickness. One sample was dried in an oven having an argon temperature at 40° C. for 24 hours and the other sample was not dried. Visual inspection of the dried sample showed development of a network of fractures or cracks which were interconnected and extended approximately parallel and perpendicular to the bedding plane with a maximum spacing of about 0.4 inch and a maximum fracture opening of about 0.04 inch width. The dimensions of the dried sample were: 1.45-inch radius × 1.45-inch radius × 2.05-inch chord × 1.05-inch thickness before drying, and 1.40-inch radius × 1.40-inch radius × 1.90-inch chord × 1.00-inch thickness after drying. The weight before drying was 37.69 grams and after drying, 28.68 grams with a 9.01 gram weight loss or a 23.9% loss consisting of moisture.

The dried and undried samples were then immersed in a 1.0 N solution of sodium hydroxide. After two hours' immersion, the undried sample was intact whereas the dried sample crumbled into small pieces. After three days' immersion, the undried sample separated into $\frac{1}{8}$–$\frac{1}{4}$-inch thick layers along the bedding plane with about 50% of the layers intact (1.76 square inch area) and the rest broken into 1.0 to 0.25 square inch pieces. After three days' immersion, the dried sample was visually inspected and the largest piece was approximately 0.25 square inch × 0.25 inch thick with most pieces smaller than a cube 0.2 inch on a side.

EMBODIMENT II

Two sub-bituminous coal samples from the Ucross seam at the Tipperary Coal Prospect near Buffalo, Wyo. were treated. Both samples were approximately 1-inch thick, $\frac{1}{8}$-circle sectors (pie-shaped wedges) cut from a 3-inch diameter core. One sample, with measurements of 1.20-inch first radius × 1.05-inch second radius × 1.00-inch chord × 0.90-inch thickness, was dried in an air-circulating oven at 32° C. After one hour of drying, a fracture network was evident with a weight loss of 5.3%. After three hours of drying, the fracture network was fully developed consisting of an approximately rectangular network of fractures with spacing randomly varying from 0.2 to 0.05 inch. The weight loss after three hours' drying was 7.1%. After $20\frac{1}{2}$ hours' drying, the weight loss was 20.4%, the fracture gaps were about 0.04 to 0.02 inch and the size of the sample measured 1.15-inch radius × 1.00-inch radius × 0.92-inch chord × 0.88-inch thickness.

The undried and dried samples were then immersed in a 1 N solution of sodium hydroxide. After two hours' immersion, there was no visual effect on the undried samples which remained intact whereas the dried sample crumbled into mostly small fragments with some large pieces approximately $\frac{1}{2}$ inch square × $\frac{1}{8}$ inch thick. After three days' immersion, the undried sample was visually inspected and consisted of one 0.4 inch thick full-layered piece, one 0.2 inch thick full-layered piece, and pieces of $\frac{1}{8}$–$\frac{1}{4}$-inch thick layers broken into $\frac{1}{4}$ square inch pieces or smaller. After three days' immersion, the dried sample was visually inspected and consisted of small fragments cubical or rectangular-faced in shape and approximately 0.2 inch on a side or less, but mostly 0.1 inch on a side.

I claim:

1. An improved process for comminuting coal wherein the coal is treated with an effective amount of a solvent selected from the group consisting of a basic aqueous solution and methanol, the improvement comprising first contacting said coal with a drying gas and continuing to contact said coal with said drying gas for a time sufficient to fracture at least a portion of said coal by the absorption of moisture from the coal thereby enhancing comminution.

2. The process of claim 1 wherein said basic aqueous solution is selected from the group consisting of sodium hydroxide, potassium hydroxide, sodium carbonate, potassium carbonate and ammonia.

3. The process of claim 1 wherein said drying gas is selected from the group consisting of air, argon, helium, carbon dioxide, methane, oxygen, oxygen-enriched air and nitrogen.

4. The process of claim 1 wherein the temperature of said dry gas is between 20° C. and 150° C.

5. An improved process for comminuting coal wherein the coal is treated with an effective amount of gaseous anhydrous ammonia, the improvement comprising first contacting said coal with a drying gas and continuing to contact said coal with said drying gas for a time sufficient to fracture at least a portion of said coal by the absorption of moisture from the coal thereby enhancing comminution.

6. The process of claim 5 wherein said drying gas is selected from the group consisting of air, argon, helium, carbon dioxide, methane, oxygen, oxygen-enriched air and nitrogen.

7. The process of claim 5 wherein the temperature of said drying gas is between 20° C. and 150° C.

8. In a process for recovering subterranean coal which comprises contacting a coal seam in-situ with a basic aqueous solution and maintaining said contact for a time sufficient to fragment at least a portion of said coal, disintegrating said portion to form a slurry, and transporting said slurry to the earth's surface to a storage vessel, the improvement comprising first injecting into the coal seam a drying gas; continuing to inject said dry gas into said coal seam for a time sufficient to fracture at least a portion of said coal by the absorption of moisture from the coal; and withdrawing moistened gas from the coal seam.

9. The process of claim 8 wherein said drying gas is selected from the group consisting of air, argon, helium, carbon dioxide, methane, oxygen, oxygen-enriched air and nitrogen.

10. The process of claim 8 wherein the temperature of said drying is between 20° C. and 150° C.

11. The process of claim 8 wherein said basic aqueous solution is selected from the group consisting of sodium hydroxide, potassium hydroxide, sodium carbonate and potassium carbonate.

* * * * *